United States Patent [19]

Bashford et al.

[11] 4,448,407

[45] May 15, 1984

[54] DUAL DIRECTIONAL DOCUMENT DRIVE APPARATUS

[75] Inventors: Anthony J. Bashford, Baden; Elbert H. Vandenham, Waterloo, both of Canada

[73] Assignee: NCR Corporation, Dayton, Ohio

[21] Appl. No.: 334,510

[22] Filed: Dec. 28, 1981

[51] Int. Cl.[3] ..... B65H 9/16

[52] U.S. Cl. ..... 271/8 A; 271/228; 271/250; 271/265; 271/273

[58] Field of Search ..... 271/8 A, 225, 227, 228, 271/250, 251, 265, 273, 274, 272, 184, 185

[56] References Cited

U.S. PATENT DOCUMENTS

| | | | |
|---|---|---|---|
| 2,181,241 | 11/1939 | Klemm | 271/225 X |
| 3,360,099 | 12/1967 | Barr | 198/21 |
| 3,595,565 | 7/1971 | Bergland | 271/251 |
| 3,779,546 | 12/1973 | Wojtowicz et al. | 271/196 |
| 3,790,162 | 2/1974 | Halbert | 271/118 |
| 3,952,874 | 4/1976 | Owen | 271/225 X |
| 3,964,739 | 6/1976 | Garcia | 271/3 |
| 4,214,740 | 7/1980 | Acquaviva | 271/3 |
| 4,314,644 | 2/1982 | Stocker | 271/225 X |

FOREIGN PATENT DOCUMENTS

| | | | |
|---|---|---|---|
| 6411411 | 4/1966 | Netherlands | 271/185 |
| 1040655 | 9/1966 | United Kingdom . | |

*Primary Examiner*—Richard A. Schacher

*Attorney, Agent, or Firm*—J. T. Cavender; Albert L. Sessler, Jr.; Elmer Wargo

[57] ABSTRACT

A sheet moving apparatus comprising: a track having first and second spaced side walls and a third wall therebetween to form a sheet receiving space therebetween; and a sheet feeder for moving a sheet towards the third wall and thereafter moving the sheet in a downstream direction along the track. The sheet feeder comprises a rotatable member having a surface positioned in the sheet receiving space and a rotary drive enabling the rotatable member and its surface to be rotated. The sheet feeder also includes a toggle member moveable between first and second positions with regard to the rotatable member, with the toggle member having a first member to cooperate with the surface of the rotatable member to move a sheet towards the third wall when the toggle member is in the first position, and the rotatable member and its surface are rotated. The toggle member also has a second member thereon to cooperate with the surface of the rotatable member to move the sheet in the downstream direction when the toggle member is in the second position and the rotatable member and its surface are rotated. An actuator and a resilient member are used for moving said toggle member between the first and second positions.

5 Claims, 5 Drawing Figures

DUAL DIRECTIONAL DOCUMENT DRIVE APPARATUS

BACKGROUND OF THE INVENTION

This invention relates to a dual-directional, document-drive apparatus which has the purpose of feeding or lowering a document in a track first and thereafter feeding or moving the document in a downstream direction in said track.

In certain document handling apparatuses, the documents are hand fed, for example, into a track to be moved downstream in the track to a utilization device such as a printer or encoder. In certain such utilization devices, it is necessary to get the document oriented in a certain way within a very short distance as measured in a downstream direction along the track. With prior art document feeding apparatuses, it was difficult to obtain the desired orientation of the document within a short distance as measured in the downstream direction mentioned.

SUMMARY OF THE INVENTION

A preferred embodiment of the document or sheet moving apparatus of this invention comprises: a track having first and second spaced side walls and a third wall therebetween to form a U-shaped, sheet-receiving space therebetween; and means for moving a sheet towards said third wall and thereafter moving said sheet in a downstream direction along said track comprising: a rotatable member having a surface positioned in said sheet receiving space and means enabling said rotatable member and its surface to be rotated; a moveable or toggle member moveable between first and second positions with regard to said rotatable member; said toggle member having a first member to cooperate with said surface of said rotatable member to move a sheet towards said third wall when said toggle member is in said first position, and said rotatable member and its surface are rotated, and said toggle member also having a second member to cooperate with said surface of said rotatable member to move said sheet in said downstream direction when said toggle member is in said second position and said rotatable member and its surface are rotated; and drive means for moving said toggle member between said first and second positions.

An advantage of the present invention is that it orients a document or sheet by having the lower edge of the sheet contact the "bottom" of the track before it is advanced in a downstream direction.

Another advantage is that the apparatus of this invention is of simple construction and is inexpensive to produce and easy to maintain.

These advantages and others will become more readily understood in connection with the following specification, claims, and drawing.

DETAILED DESCRIPTION OF THE INVENTION

Figure 1:
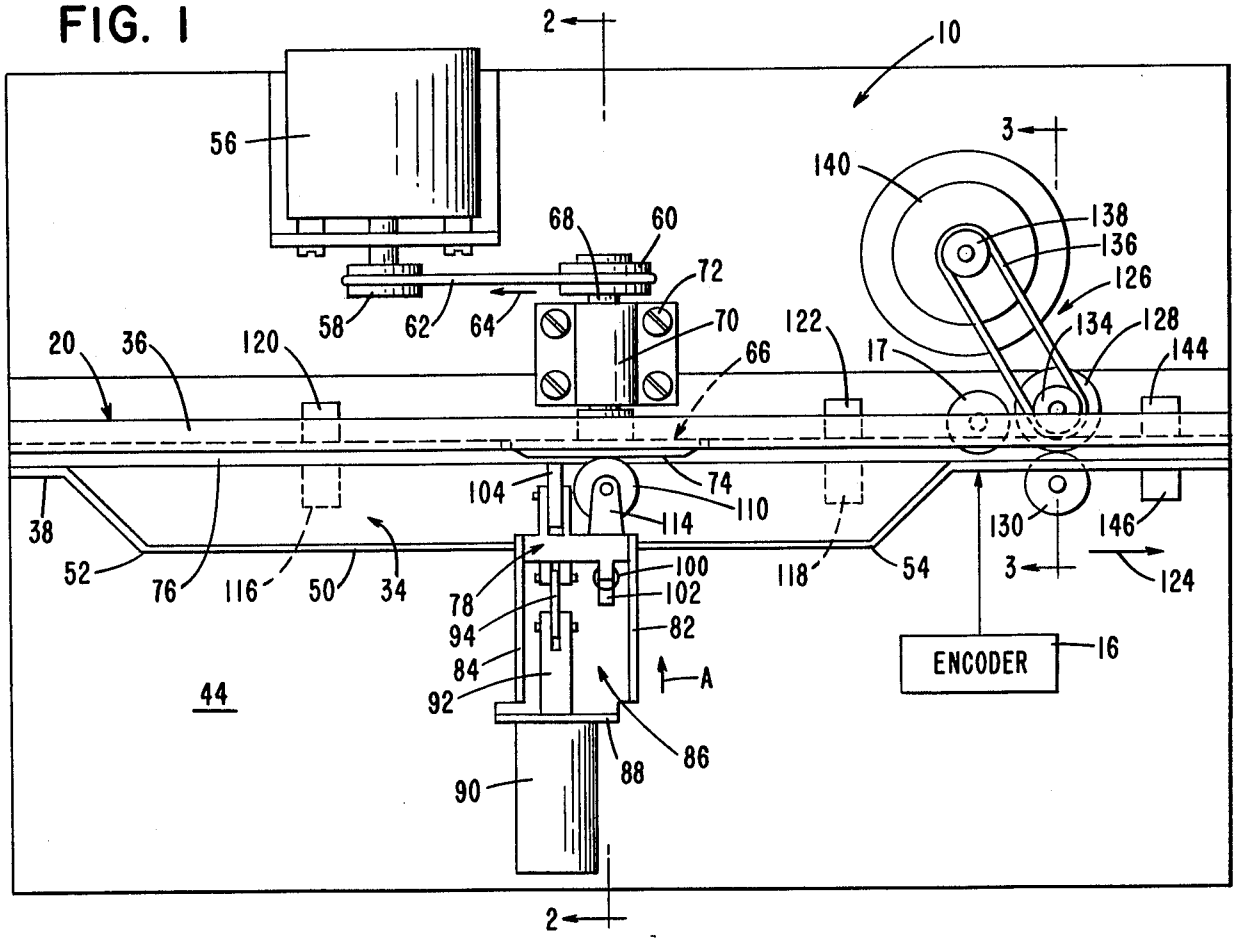
FIG. 1 is a plan view showing a preferred embodiment of this invention, having a rotatable member and a toggle member which is moveable between first and second positions with regard to the rotatable member.

FIG. 1 is a plan view of a preferred embodiment of the apparatus of this invention which is designated generally as 10. Before discussing the details of the apparatus, it appears useful to explain how the apparatus 10 is used.

In certain operations, it is necessary to orient a document or sheet prior to moving it to a utilization device, as stated earlier herein. For example, it may be necessary to orient a document or sheet so that its lower-most edge contacts the bottom of a track so that encoding or printing may occur at a fixed distance above the lowermost edge of the document. In one of those operations, it is necessary that the orienting of the document be accomplished within a very short distance as measured along the downstream direction of the track. The present invention is especially adaptable for such an operation or application although its use may be extended to other feeding operations.

Figure 3:
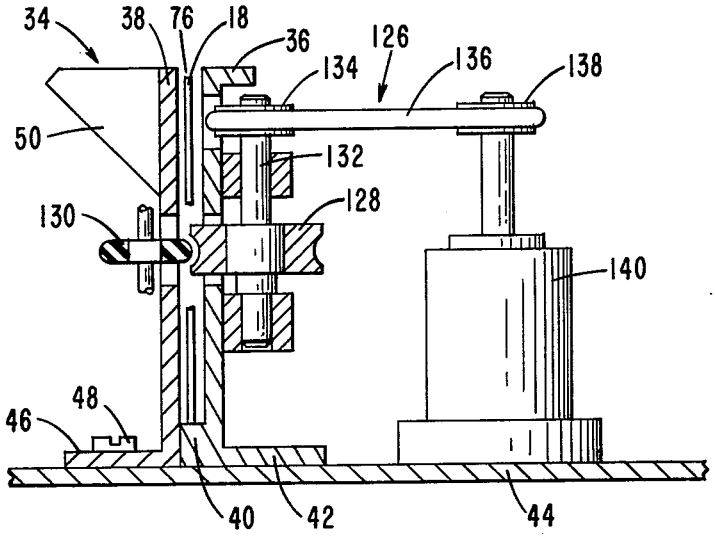
FIG. 3 is a cross-sectional view, taken along the line 3—3 of FIG. 1, to show additional details of means for feeding the documents or sheets in a downstream direction.
Figure 4:
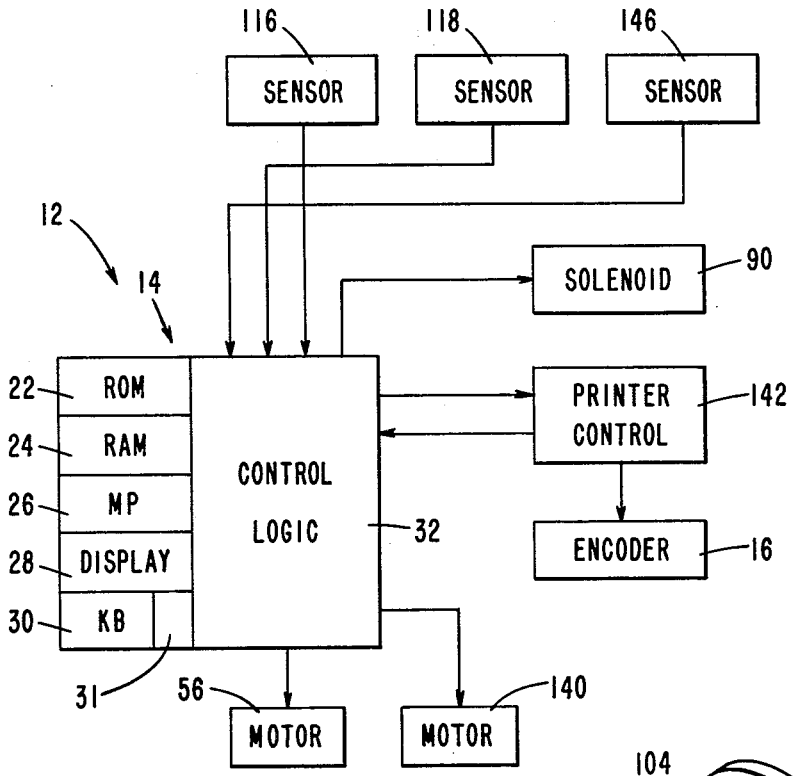
FIG. 4 is a schematic diagram, in block form, showing a control means which may be used with this invention.

The apparatus 10 may be incorporated in a terminal 12, only portions of which are shown diagrammatically in FIG. 4. The terminal 12 includes a control means 14 and a printer or encoder 16. One of the functions of the encoder 16, also shown in FIG. 1, is to print or encode certain data on a document or sheet like 18 (FIGS. 2 and 3) which is moved along a guiding means or track designated generally as 20. The documents or sheets may be bank checks or invoices, for example, which are to have certain monetary amounts printed or encoded thereon in characters or bar codes, for example, at the encoder 16.

The control means 14 for controlling the operation of the terminal 12 may be conventional and includes a read only memory (ROM) 22 (in which instructions or programs are stored), a random access memory (RAM) 24, a processor such as a microprocessor (MP) 26, a display 28 for communicating with a user of the terminal 12, a keyboard (KB) 30 for entering data, and conventional control logic 32 which contains the appropriate logic circuitry and interfaces which enable the terminal 12 to function as what is considered an "intelligent" terminal. Because the control means 14 may be conventional, it need not be described in any further detail herein.

In a typical use of the apparatus 10, an operator of the terminal 12 enters on the keyboard 30 (FIG. 4) the monetary amount to be applied to or encoded on a document or sheet 18 in the example previously described. The operator then depresses an actuation key 31 on the keyboard 30 to initiate the operation of the apparatus 10, and thereafter, the operator drops the sheet 18 (with the long bottom edge of the sheet lowermost) into a receiving area 34 associated with the track 20 (FIG. 1).

Figure 2:
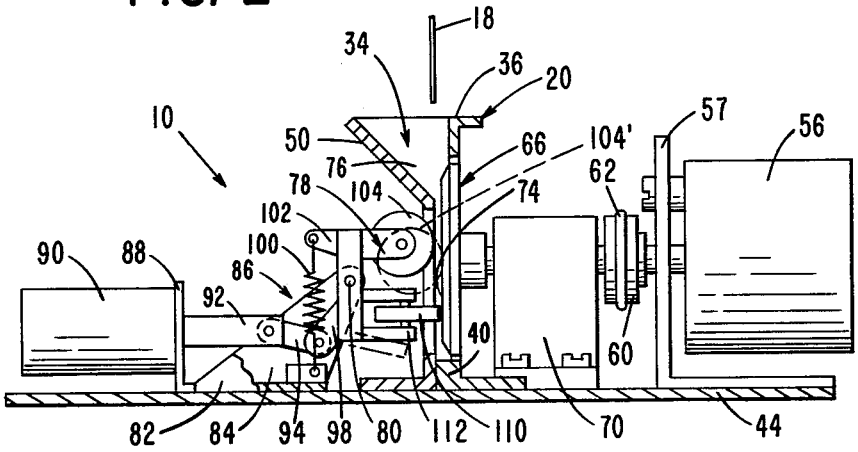
FIG. 2 is an elevational view of this invention when looking in an upstream direction as viewed from line 2—2 of FIG. 1.

The track 20 (FIG. 1) is made up of a first sidewall 36 and a second side wall 38 as best seen in FIG. 3, for example. The first side wall 36 has a third wall or bottom 40 and a flange 42 to enable it to be secured to the mounting plate 44 of the apparatus 10. The second side wall 38 has a flange 46 to enable it to be secured to the mounting plate 44 by fasteners like 48. The sheet receiving area 34 (FIG. 1) is formed by having a portion 50 of the second side wall 38 extend outwardly as shown in FIG. 2. In the embodiment described, the length of the receiving area 34, as viewed from the top as seen in FIG. 1, is about six inches as measured between corner bends 52 and 54; accordingly, the apparatus 10 handles or receives a sheet like 18 having a length of six inches or less with a height of about four inches as viewed in FIG. 3. Naturally, these dimensions could be changed to suit particular applications.

When the actuation key 31 (FIG. 4) is actuated, it energizes the motor 56 via the control logic 32. The motor 56 is part of the apparatus 10 shown in FIGS. 1 and 2, and is secured to the mounting plate 44 via a bracket 57.

The motor 56 has an output pulley 58 which is drivingly coupled to pulley 60 by an endless belt 62, with the motor 56 being operated to move or drive the belt 62 in the direction of arrow 64.

The apparatus 10 also includes a rotatable member which will be referred to hereinafter as disc 66. Disc 66 has one end of a shaft 68 (FIG. 1) secured thereto, and the shaft 68 extends therefrom and is mounted in a bearing support 70 which is secured to the mounting plate 44 by fasteners 72. The remaining end of the shaft 68 has the pulley 60 secured thereto to enable the shaft 68 and the disc 66 to be rotated by the motor 56.

The disc 66 (FIGS. 1 and 2) is inserted through an opening in the sidewall 36 and is positioned so that its circular, planar surface 74 extends about halfway into the space 76 between the side walls 36 and 38. When the motor 56 is energized, the disc 66 and its planar surface 74 are rotated in a counterclockwise direction as viewed from the direction A shown in FIG. 1.

Figure 5:
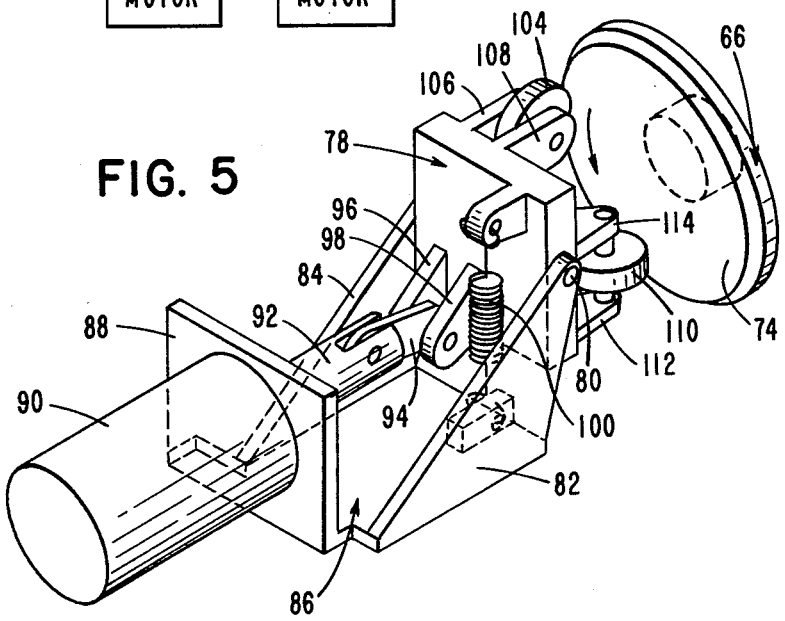
FIG. 5 is a general respective view of the toggle member shown in FIGS. 1 and 2.

The apparatus 10 also includes a moveable or toggle member designated generally as 78 and shown in FIGS. 1, 2 and 5. The toggle member 78 has short axles like 80 (FIG. 5) extending from opposed sides thereof, and these axles are pivotally supported in arms 82 and 84 of a mounting bracket 86 which is secured to the mounting plate 44. The mounting bracket 86 also has an upturned flange 88 in which a solenoid 90 is secured. The operating plunger 92 (FIG. 5) of the solenoid 90 is pivotally joined to one end of a link 94 whose remaining end is positioned between the supports 96 and 98 and is pivotally joined thereto. The supports 96 and 98 extend from one side of the toggle member 78 as is best shown in FIG. 5.

When the solenoid 90 is energized by the control means 14, the toggle member 78 is pivoted about its axles 80 in a clockwise direction as viewed in FIG. 2 to a first position with regard to the disc 66. When the solenoid 90 is de-energized, a tension spring 100, having one end connected to the mounting bracket 86 and the remaining end connected to an extension 102 on the toggle member 78, causes the toggle member 78 to pivot about its axles 80 in a counterclockwise direction to a second position shown in FIGS. 1 and 2.

The toggle member 78 has a first member or roller 104 thereon, with the roller 104 being rotatably mounted between supports 106 and 108, as is best shown in FIG. 5, and with the axis of rotation of the roller 104 being horizontal. The toggle member 78 similarly has a second member or roller 110 thereon, with the roller 110 being rotatably mounted between supports 112 and 114. The axis of rotation of roller 110 is vertical as viewed in FIG. 5.

When the toggle member 78 is moved to the first position by energizing the solenoid 90, the first member or roller 104 advances toward the surface 74 of disc 66 to engage it as shown by the dashed outline 104' of the roller 104 in FIG. 2, and the second member or roller 110 pivots away from the disc 66. A document or sheet 18, which is fed manually downwardly (as viewed in FIG. 2) into the sheet receiving area 34, will be driven or moved downwardly (in a tangential manner) towards the bottom 40 of the track 12 due to the rotation of disc 66 and roller 104 which functions as a pinch roller. As a sheet 18 is moved downwardly, its lower edge will be detected by sensors 116 and 118 (FIG. 1) which are positioned along one side of the track 20 so as to provide a signal when the lower edge of the sheet 18 contacts the bottom 40 (FIG. 2) of the track 20. The sensors 116 and 118 are conventional, and have sources of light 120 and 122, respectively, located on the opposite side of the track 20. The sensors 116 and 118 each provide a signal when the light thereto is interrupted by the lower edge of a sheet 18. The outputs of the sensors 116 and 118 are suitably ANDed by the control logic 32 to provide a signal which de-energizes solenoid 90, as the sheet is now positioned with its lower edge contacting the bottom 40 of the track 20.

When the solenoid 90 is de-energized, the toggle member 78 is pivoted to the second position (as shown in full lines in FIGS. 1 and 2) through the action of spring 100. In this second position, the roller 110 forces the sheet 18 into engagement with the surface 74 of the rotating disc 66 to move or feed the sheet 18 in a downstream direction in track 20, as indicated by arrow 124 in FIG. 1.

From what has been just described, it should be noted that a document or sheet 18 is first moved downwardly towards the bottom 40 of the track 20, and thereafter, it is moved in a downstream direction (arrow 124). This orienting and then moving or feeding of the sheet 18 is accomplished within a very short distance as measured along the downstream direction so as to enable the sheet 18 to be properly oriented with the lower edge thereof contacting the bottom 40 of the track 20 when the sheet reaches the encoding station 16 (FIG. 1).

Certain modifications of the apparatus 10 are possible to meet particular applications. For example, the roller 104 may be located (on the toggle member 78) further to the left (as viewed in FIG. 1) relative to the rotating disc 66 to increase the velocity of movement of the sheet 18 in the downward direction as previously described. Correspondingly, the roller 110 may be located (on the toggle member 78) further downwardly (as viewed in FIG. 2) relative to the rotating disc 66 to increase the velocity of movement of the sheet 18 in the downstream direction (in the track 20) as indicated by arrow 124. To accomplish this flexibility, the supports 106 and 108 (FIG. 5) for roller 104 and the supports 112 and 114 for roller 110 may be adjustably mounted on the toggle member 78. In the embodiment described, the disc 66 has a diameter of 48 mm. and it is rotated at a velocity of 600 revolutions per minute. The roller 104 is positioned to effect a downward velocity of about 1300 mm. per second, and the roller 110 is positioned to effect a velocity in the downstream direction of about 1300 mm. per second. The rollers 104 and 110 are made of a plastic material like urethane, and the surface 74 of disc 66 is made of stainless steel. Naturally, the velocities and materials can be changed to suit particular applications.

Another modification possible is that the sensors 116 and 118 (FIG. 1) may be replaced by a single sensor (not shown) which is positioned below the roller 104 as viewed in FIG. 1. Generally, when the center of the lower edge of a sheet like 18 is located on the bottom 40 of the track, it means that the lower edges of the sheet near its leading and trailing edges also contact the bottom 40. However, using two sensors 116 and 118 provides more positive detection.

FIG. 3 shows a conventional feed mechanism 126 for moving or feeding the sheets like 18 in the downstream direction along track 20. The feed mechanism 126 includes a drive roller 128 which is rotatably mounted on the side wall 36 to cooperate with a pinch roller 130 which is rotatably mounted on the side wall 38 and is resiliently biased to move towards the drive roller 128 as is conventionally done. The driving shaft 132 of drive roller 128 has a driving pulley 134 fixed thereto to be rotated by an endless belt 136 which is coupled to the driving pulley 138 of motor 140. Drive roller 128 is rotated in a counterclockwise direction (as viewed in FIG. 1) by the motor 140.

The encoder 16 (FIG. 1) usually has its own conventional feed means 17 (shown in dashed outline as a drive roller) associated therewith to move the sheets like 18 at the appropriate rate to effect encoding of the sheet at the encoder 16. The feed mechanism 126 shown in FIG. 3 is of the "soft" variety which means that the coefficient of friction between the drive roller 128 and the pinch roller 130 is such as to enable drive roller 128 to rotate or "slip" on the surface of sheet 18 as, for example, the feed means 17 at the encoder 16 moves the sheet 18 at the encoding rate of encoder 16 which usually is slower than the feeding rate provided by drive rollers like 128.

A conventional printer control 142 (FIG. 4) is used to format the data to be encoded by the encoder 16. A source of light 144 (FIG. 1) located on one side of track 20 and its associated light sensor 146 located on the opposite side of the track are used to inform the control means 14 that the trailing edge of a sheet like 18 is out of the encoder 16, and that the next sheet like 18 may be hand fed into the sheet receiving area 34 (FIG. 1) to repeat the process as described. The encoder 16 may have its own sensors (not shown) similar to sensor 146, for example, which are positioned along the track 20 to detect the leading edge, for example, of a sheet 18 thereat so as to initiate the encoding or printing. Because this aspect is conventional, it need not be described in any further detail.

I claim:

1. A sheet moving apparatus comprising:

a track having first and second spaced side walls and a third wall therebetween to form a sheet receiving space therebetween; and means for moving a sheet towards said third wall and thereafter moving said sheet in a downstream direction along said track comprising:

a rotatable member having a surface positioned in said sheet receiving space and means enabling said rotatable member and its surface to be rotated;

a moveable member moveable between first and second positions with regard to said rotatable member;

said moveable member having a first member to cooperate with said surface of said rotatable member to move a sheet towards said third wall when said moveable member is in said first position and said rotatable member and its surface are rotated, and said moveable member also having a second member to cooperate with said surface of said rotatable member to move said sheet in said downstream direction when said moveable member is in said second position and said rotatable member and its surface are rotated; and drive means for moving said moveable member between said first and second positions.

2. A sheet moving apparatus comprising:

a track having first and second spaced side walls and a third wall therebetween to form a sheet receiving space therebetween; and means for moving a sheet towards said third wall and thereafter moving said sheet in a downstream direction along said track comprising:

a rotatable member having a surface positioned in said sheet receiving space and means enabling said rotatable member and its surface to be rotated;

a moveable member moveable between first and second positions with regard to said rotatable member;

said moveable member having a first member to cooperate with said surface of said rotatable member to move a sheet towards said third wall when said moveable member is in said first position and said rotatable member and its surface are rotated, and said moveable member also having a second member to cooperate with said surface of said rotatable member to move said sheet in said downstream direction when said moveable member is in said second position and said rotatable member and its surface are rotated; and drive means for moving said moveable member between said first and second positions;

said drive means comprising an actuator to move said moveable member to said first position when said actuator is energized, a resilient means to move said moveable member to said second position when said actuator is de-energized, and means for sensing when an edge of said sheet is positioned at said third wall to produce a signal which de-energizes said actuator, permitting said resilient means to move said moveable member to said second position;

said rotatable member being a disc and said moveable member being a toggle member.

3. The apparatus as claimed in claim 2 in which said first and second members are pinch rollers which are rotatably mounted on said toggle member and have their axes of rotation positioned at substantially a right angle to each other.

4. The apparatus as claimed in claim 3 in which said surface of said rotatable member is made of stainless steel and said pinch rollers are made of a plastic material.

5. A sheet moving apparatus comprising:

a track having first and second spaced side walls and a third wall therebetween to form a sheet receiving space therebetween; and means for moving a sheet towards said third wall and thereafter moving said sheet in a downstream direction along said track comprising:

a rotatable member having a surface positioned in said sheet receiving space and means enabling said rotatable member and its surface to be rotated;

a moveable member moveable between first and second positions with regard to said rotatable member;

said moveable member having a first member to cooperate with said surface of said rotatable member to move a sheet towards said third wall when said moveable member is in said first position and said rotatable member and its surface are rotated, and said moveable member also having a second member to cooperate with said surface of said rotatable member to move said sheet in said downstream direction when said moveable member is in said second position and said rotatable member and its surface are rotated; and drive means for moving said moveable member between said first and second positions;

said rotatable member being a disc and said moveable member being a toggle member.

* * * * *